US006239341B1

(12) United States Patent
Wang

(10) Patent No.: US 6,239,341 B1
(45) Date of Patent: May 29, 2001

(54) ELASTIC MOUNTING DEVICE FOR A TOM-TOM DRUM HOLDER

(76) Inventor: Wei-Pin Wang, PO Box 82-144, Taipei (TW)

( * ) Notice: Subject to any disclaimer, the term of this patent is extended or adjusted under 35 U.S.C. 154(b) by 0 days.

(21) Appl. No.: 09/523,593

(22) Filed: Mar. 10, 2000

(51) Int. Cl.[7] ..... G10D 13/02
(52) U.S. Cl. ..... 84/421; 84/327
(58) Field of Search ..... 84/421, 327, 411 R, 84/419, 420

(56) References Cited

U.S. PATENT DOCUMENTS 4,126,075 * 11/1978 Kurosaki ..... 84/421
4,596,176 * 6/1986 Gauger ..... 84/421
4,903,570 * 2/1990 Sassmannshausen et al. ..... 84/421
5,461,959 * 10/1995 Sassmannshausen et al. ..... 84/421
6,060,652 * 5/2000 Lombardi ..... 84/421

* cited by examiner

*Primary Examiner*—Shih-Yung Hsich
(74) *Attorney, Agent, or Firm*—A & J

(57) ABSTRACT

An elastic mounting device for a tom-tom drum holder includes a counterhoop body connected to the batter head of the drum and a holder for supporting the drum, characterized in that the holder is mounted aerially and two ends of the holder are provided with holes for the insertion of screw rods for tightening, the screw rods are externally mounted with an elastic collar and the screw rods with the elastic collar are then inserted into positioning holes provided on the counterhoop body, the inner edge of the counterhoop body is provided with a pad and a fastening nut for securing together with the holder, thereby by means of the mounting of the elastic collar with the screw rods, the drum vibrates slightly in accordance with the beating of the batter head of the

1 Claim, 5 Drawing Sheets

ELASTIC MOUNTING DEVICE FOR A TOM-TOM DRUM HOLDER

BACKGROUND OF THE INVENTION a) Technical Field of the Invention

The present invention relates to an elastic mounting device for a tom-tom drum holder, and in particular, to screw rods mounted externally with elastic collars for mounting to positioning holes provided on the counterhoop of the drum.

b) Description of the Prior Art

FIG. 5 shows a conventional mounting structure for a tom-tom drum holder 30. The holder 30 is provided with holes 31 at the four comers thereof for the mounting of screw rods 32 with the counterhoop body 33 of the drum. A screw nut 35 provided at the inner surface of the counterhoop 33 is locked with the holder 30. In this conventional mounting device, there is no any component to provide vibration effect of the drum caused by sound resonance when the drum is beaten. Some manufactures modify the four screw rods 32 by mounting a pad 34 to the bottom section of the holder 30 (as shown in FIGS. 6–8) and in combination with two vertical end plates to mount the screw rod 32 to the counterhoop body 33. This modification is to provide elasticity to the drum such that the drum will appropriately vibrate, i.e., to provide resonance effect and the quality of sound produced by beating of drum becomes excellent. These conventional structures make use of screw rods to directly mount the holder 30 to the counterhoop 33. However, when the drum is beaten, the tightness of the drum mounted to the holder will become loose, and the sound quality of the sound produced by the drum is affected. In particular, when the screw rods 32 are made from metallic material. If the mounting device is made of wood, gap may be formed at the connection of the metallic material and the wood material. Thus, the mounting of the holder has to be adjusted again. In practice, as the pad 34 is thin, he pad 34 loses its elasticity after some time of use. Thus, the function of the pad 34, in this case, is very limited.

SUMMARY OF THE INVENTION

Accordingly, an object of the present invention is to provide an elastic mounting device for a tom-tom drum holder comprising a counterhoop body connected to the batter head of the drum and a holder for supporting the drum, characterized in that the holder is mounted aerially and two ends of the holder are provided with holes for the insertion of screw rods for tightening, the screw rods are externally mounted with an elastic collar and the screw rods with the elastic collar are then inserted into positioning holes provided on the counterhoop body, the inner edge of the counterhoop body is provided with a mounting pad and a fastening nut for securing together with the holder, thereby by means of the mounting of the elastic collar with the screw rods, the drum vibrates slightly in accordance with the beating of the batter head of the drum.

Yet another object of the present invention is to provide an elastic mounting device for a tom-tom drum holder, wherein the tightness of the holder with the tom-tom drum can be adjusted so as to provide appropriate vibration effect of the drum when the batter head of the drum is beaten.

Another object of the present invention is to provide an elastic mounting device for a tom-tom drum holder, wherein the tightening of the holder will not damage the counterhoop of the drum.

A further object of the present invention is to provide an elastic mounting device for a tom-tom drum holder, wherein the beating of the batter head can produce excellent sound.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
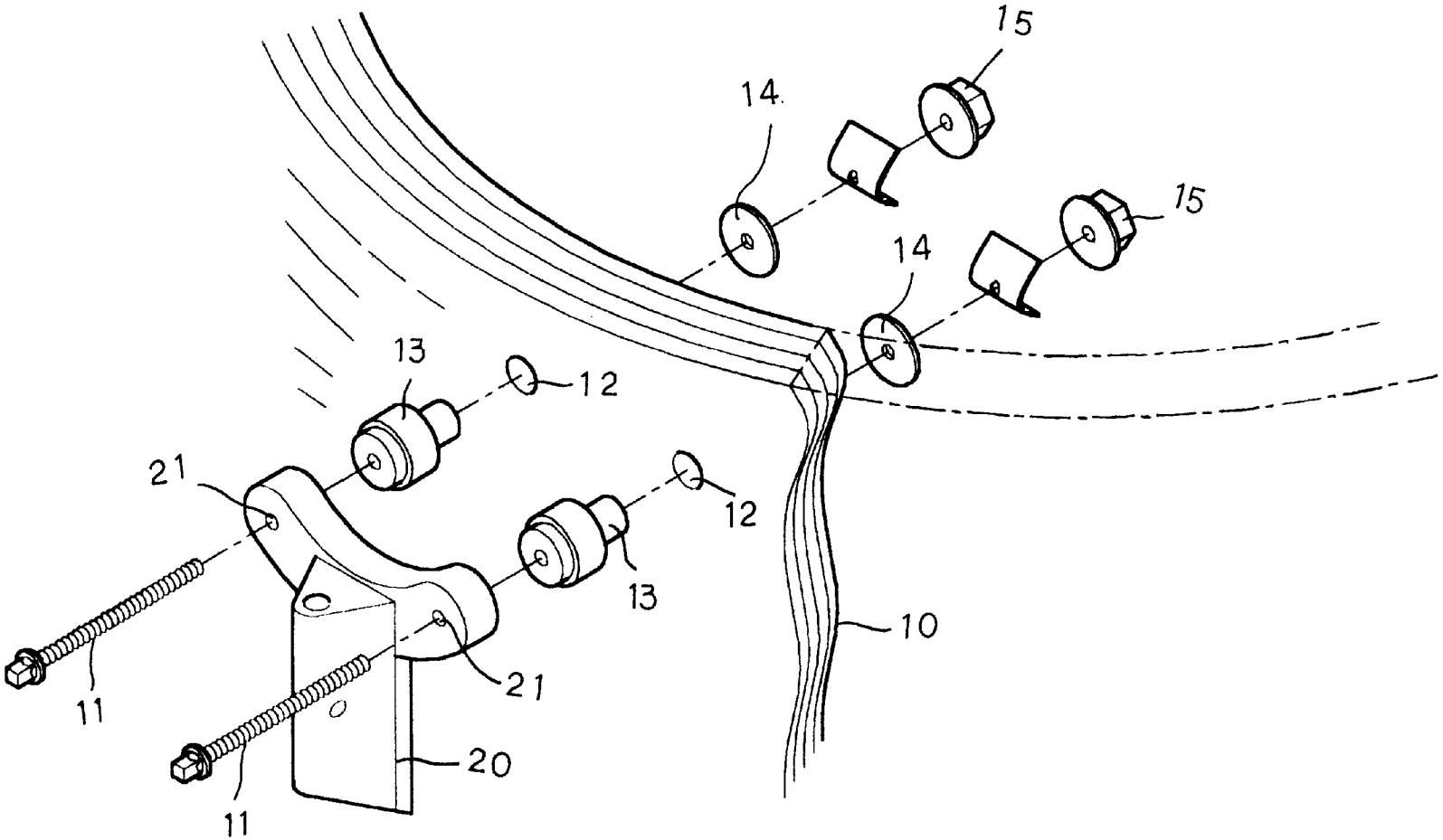
FIG. 1 is a perspective exploded view of an elastic mounting device for a tom-tom drum holder of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
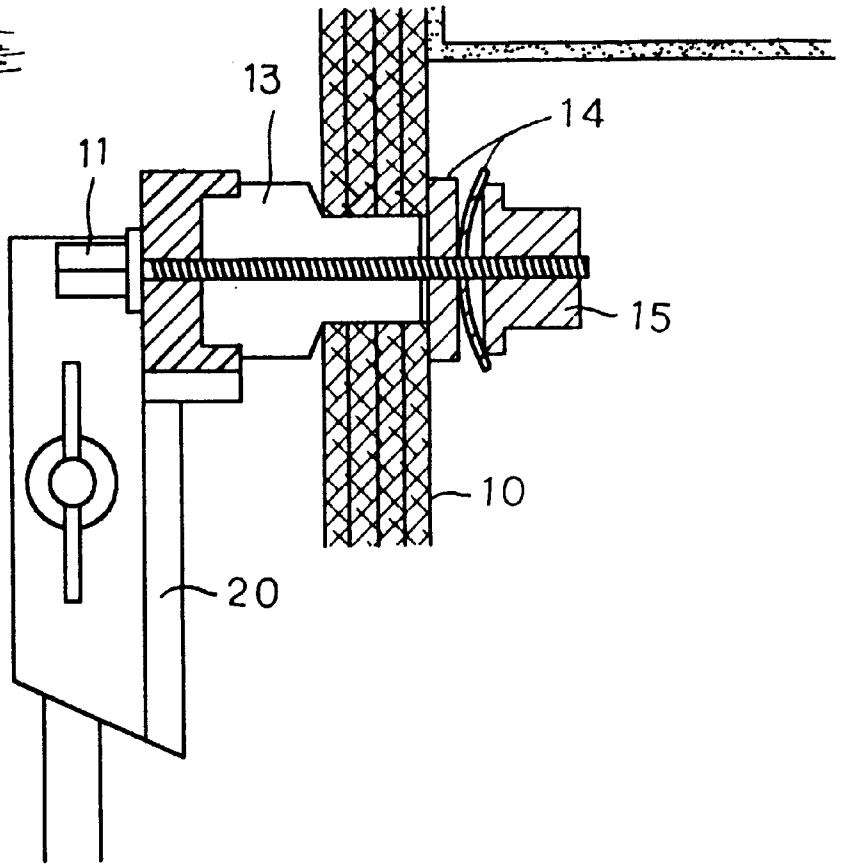
FIG. 2 is a sectional view of the elastic mounting device of the present invention.
Figure 3:
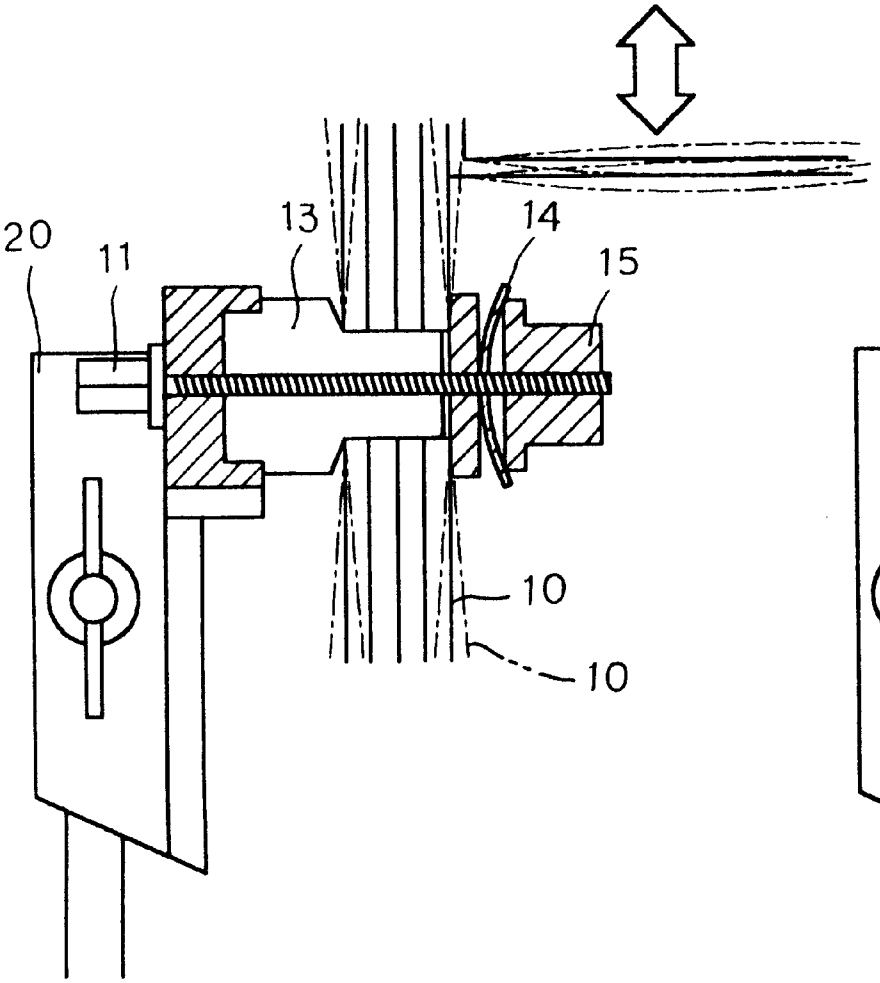
FIG. 3 is a schematic view showing the vibration of the batter head of the tom-tom drum of the present invention.
Figure 4:
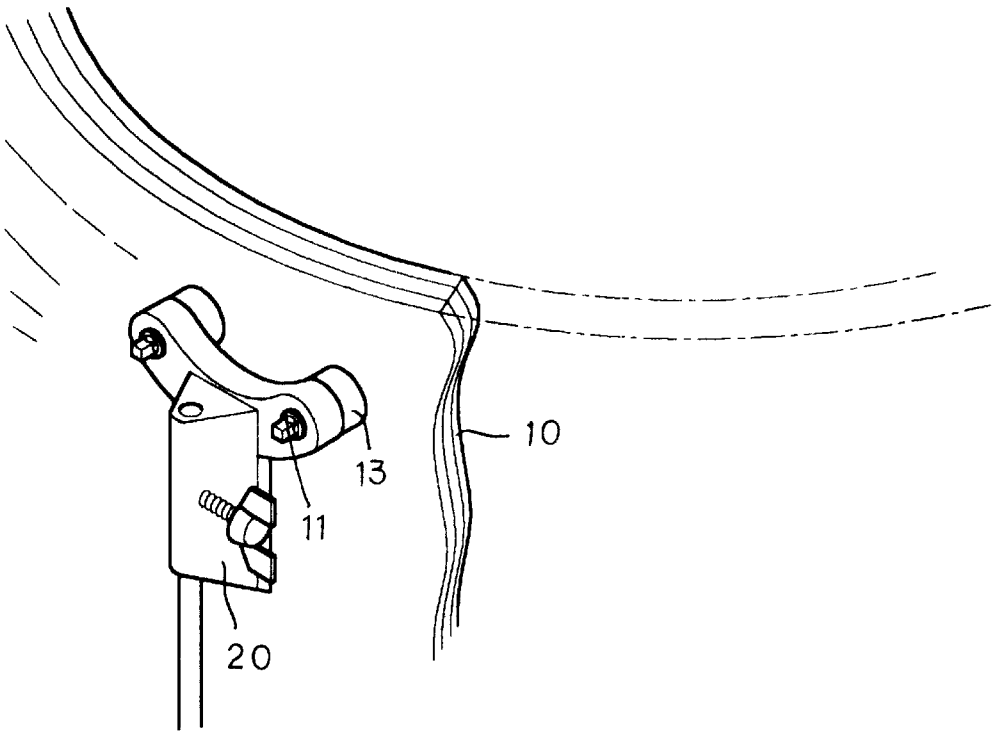
FIG. 4 is a perspective view of the elastic mounting device of the tom-tom drum holder of the present invention.
Figure 5:
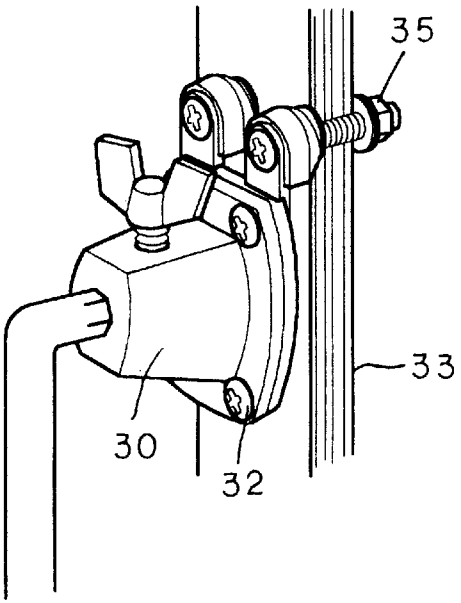
PRIOR ART FIG. 5
FIG. 5 is a perspective view of a conventional mounting device for a tom-tom drum holder.
Figure 6:
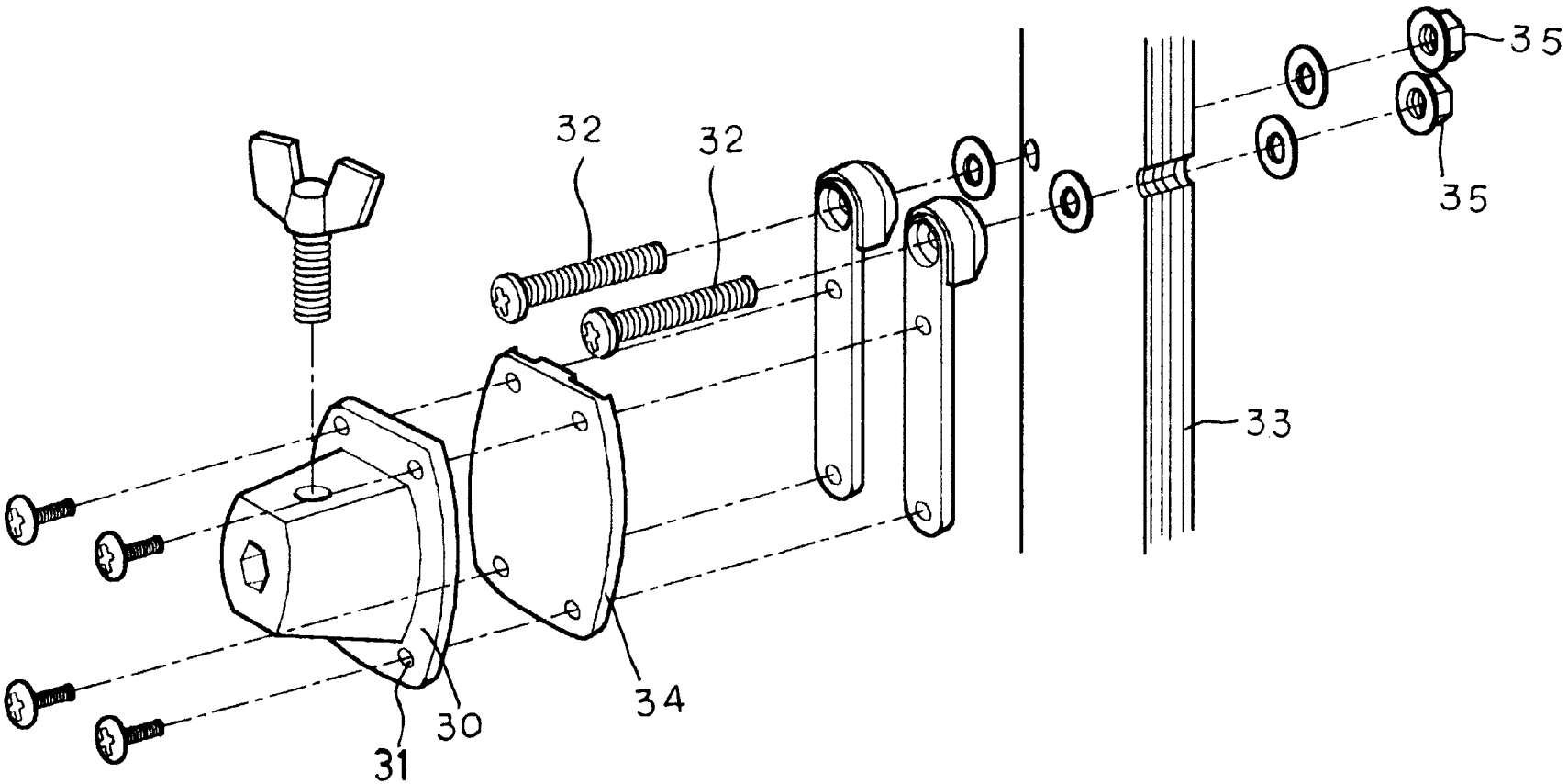
PRIOR ART FIG. 6
FIG. 6 is a perspective exploded view of another conventional mounting device for a tom-tom drum holder of the present invention.
Figure 7:
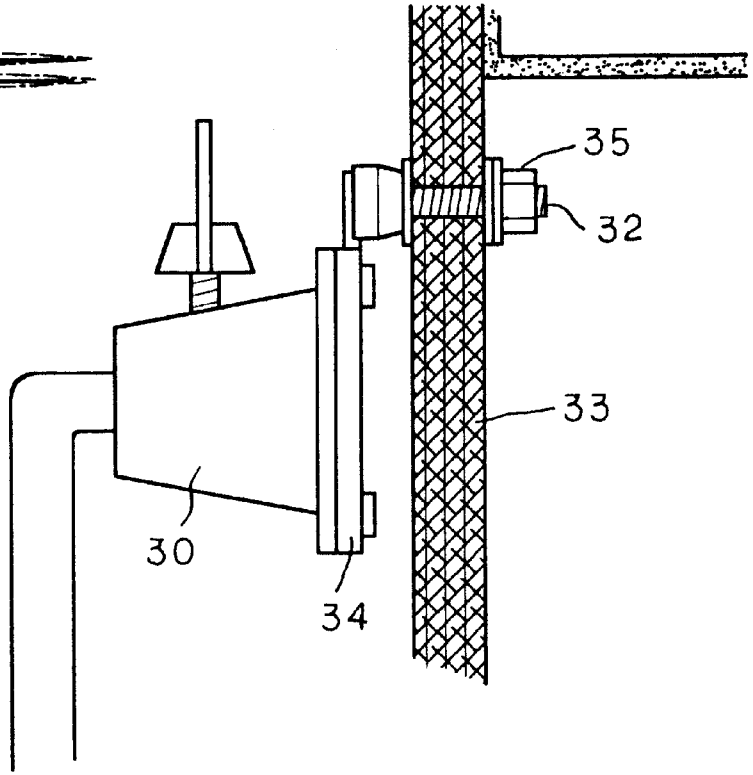
PRIOR ART FIG. 7
FIG. 7 is a sectional view of the mounting device shown in FIG. 6.
Figure 8:
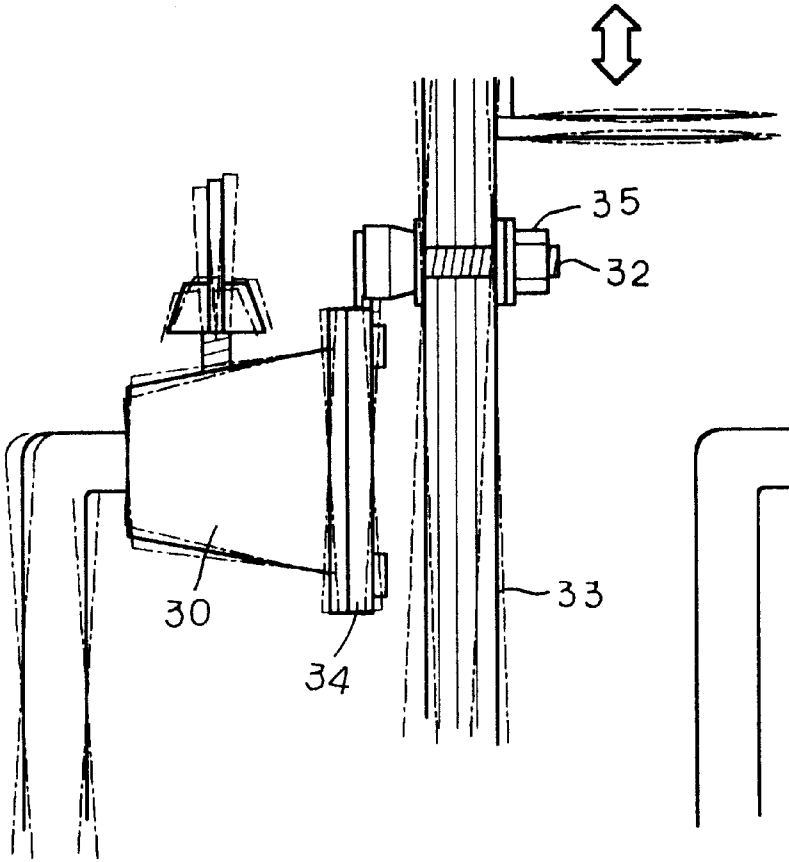
PRIOR ART FIG. 8
FIG. 8 is a sectional view showing the vibration of a conventional mounting device for a tom-tom drum.

Referring to FIGS. 1 to 4, there is shown an elastic mounting device for a tom-tom drum holder comprising a counterhoop body 10, a holder 20, and screw rods 11. A one piece elastic collar 13 is designed into a stepped-like structure with smaller diameters at both stepped ends as shown in FIGS. 1 to 3. Positioning holes 12 are provided on the counterhoop body 10 of the tom-tom drum and have a large diameter for mounting with one stepped end of the elastic collar 13. The holder 20 is used to mount the tom-tom drum aerially. A mounting end of the holder 20 is designed into a stepped-like slot as shown in FIGS. 2 and 3 for insertion of other stepped end of the collar 13. The screw rod 11 directly passes through the elastic collar 13 and is protruded out from the other end of the collar 13. Then, the entire holder 20, with the collar 13 is directly mounted to the positioning hole 12 on the counterhoop body 10. The other inner edge of the counterhoop 10 is provided with flat pad or disc-like pad 14 and then a locking screw nut 15 is used to fasten the screw rod 1 1 at the end thereof such that the holder 20 is mounted aerially together with the drum.

The holder 20 is mounted aerially to the drum by means of the elastic collar 13 and the screw rods 11. Accordingly, there are numbers of advantages as follows:

(1) There is no direct contact of metallic material with wood material for the entire counterhoop surface of the drum and the screw rod 11, and thus, gap formed as a result of vibration while the drum is beaten is avoided. That is, the widening in diameter of the positioning hole 12 on the counterhoop body 10 will not be occurred. Thus, the mounting of tom-tom drum is further secured. Particularly, the elastic collar 13 mounted in between the metallic screw rod 11 and the counterhoop surface can provide an appropriate elasticity while the batter head of the drum is beaten. In other words, when the batter head of the drum is beaten, the entire tom-tom drum will appropriately vibrate. This can maintain excellent quality of sound of drum. The stepped-like elastic collar 13 provides the entire holder 20 an effect of aerial mounting of the drum. This type of aerially mounting of drum improves the quality of sound effect of the drum while it is beaten. In accordance with the present invention, the disc-like pad 14 mounted to the mounting device provides excellent tightening of the drum, and the vibration effect of the drum can be adjusted. That is, the effectiveness of the resonant produced by the drum can be adjusted. The adjusting of tightness of mounting of the holder 20 of the drum will adjust the tightness of the elastic collars 13.

In accordance with the present invention, the mounting of drums by the mounting device is safe and secured and the sound dynamic of the drum can be easily adjusted.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An elastic mounting device for a tom-tom drum holder comprising a counterhoop body connected to a batter head of a drum and a holder for supporting the drum, wherein the holder is mounted aerially and two ends of the holder are provided with holes for the insertion of screw rods for tightening, the screw rods are externally mounted with a one piece elastic collar which is designed into a stepped-like structure, at both ends and the screw rods with one stepped end of the elastic collar are then inserted into positioning holes provided on the counterhoop body, a mounting end of the holder is a stepped-like slot for insertion of other stepped end of the elastic collar, an inner edge of the counterhoop body is provided with a mounting pad and a fastening nut for securing together with the holder, the mounting pad being a flat structure or a disc-like structure to provide tightening when the screw rods are fastened, thereby by means of the mounting of the elastic collar with the screw rods, the drum vibrates slightly in accordance with the beating of the batter head of the drum.

* * * * *